US008018797B2

(12) United States Patent
Wu

(10) Patent No.: US 8,018,797 B2
(45) Date of Patent: Sep. 13, 2011

(54) DEVICE FOR DISPLAYING REAL TIME AND ADVERTISING MEDIA

(76) Inventor: Wen Chen Wu, Port Washington, NY (US)

( * ) Notice: Subject to any disclaimer, the term of this patent is extended or adjusted under 35 U.S.C. 154(b) by 1277 days.

(21) Appl. No.: 11/595,032

(22) Filed: Nov. 10, 2006

(65) Prior Publication Data

US 2010/0246334 A1 Sep. 30, 2010

Related U.S. Application Data

(60) Provisional application No. 60/785,670, filed on Mar. 24, 2006.

(51) Int. Cl.
*G04B 19/24* (2006.01)
*G04B 37/12* (2006.01)
*G09D 3/04* (2006.01)

(52) U.S. Cl. ..... 368/41; 368/278; 40/121

(58) Field of Classification Search ..... 368/10, 368/28, 41, 88, 278; 40/121; 283/2
See application file for complete search history.

(56) References Cited

U.S. PATENT DOCUMENTS

| | | | | | |
|---|---|---|---|---|---|
| 929,940 | A * | 8/1909 | Hall | 368/280 |
| 956,230 | A * | 4/1910 | Thompson | 368/106 |
| 1,018,641 | A * | 2/1912 | Strayer | 40/121 |
| D105,811 | S * | 8/1937 | Sherman | D10/2 |
| 2,160,104 | A * | 5/1939 | Kulow | 40/119 |
| 2,223,917 | A * | 12/1940 | McGloin | 368/44 |
| 2,504,277 | A * | 4/1950 | Otterson | 40/124.11 |
| D182,682 | S * | 4/1958 | Nelson | D20/20 |
| D221,462 | S * | 8/1971 | Rittinghaus | D10/3 |
| 4,279,086 | A * | 7/1981 | Phillips | 40/763 |
| D282,377 | S * | 1/1986 | Curran | D19/26 |
| 4,682,310 | A * | 7/1987 | Lund et al. | 368/278 |
| 4,740,932 | A * | 4/1988 | Cephas et al. | 368/28 |
| 4,895,393 | A * | 1/1990 | Shimizu | 281/15.1 |
| 5,030,027 | A * | 7/1991 | Bachrach et al. | 402/4 |
| 5,271,172 | A * | 12/1993 | Ureta | 40/107 |
| D347,178 | S * | 5/1994 | Taphorn | D10/24 |
| 5,525,958 | A * | 6/1996 | Negishi et al. | 340/309.7 |
| 5,537,369 | A * | 7/1996 | Wu | 368/10 |
| 5,709,495 | A * | 1/1998 | Brunner | 402/73 |
| 5,934,707 | A * | 8/1999 | Johnson | 283/2 |
| 6,920,975 | B1 * | 7/2005 | Salander et al. | 206/215 |
| 7,225,567 | B1 * | 6/2007 | Cunningham et al. | 40/124.12 |
| 2003/0136036 | A1 * | 7/2003 | Zubli | 40/124.15 |
| 2004/0149865 | A1 * | 8/2004 | Bond | 248/115 |
| 2005/0240470 | A1 * | 10/2005 | Bury | 705/14 |
| 2007/0096456 | A1 * | 5/2007 | Silverman | 281/51 |
| 2007/0147182 | A1 * | 6/2007 | Witchey et al. | 368/223 |
| 2007/0287140 | A1 * | 12/2007 | Liebowitz | 434/304 |

* cited by examiner

*Primary Examiner* — Vit Miska

(57) ABSTRACT

The present invention is a device for displaying real time and advertising media to a person. In one embodiment, the device comprises a front cover, a clock engaged with said front cover for displaying real time, and a first sheet having an advertising portion. The first sheet is moveably engaged with the front cover to an open position where the real time and advertising portion are visible to the person. The clock comprises a clock movement mechanism engaged with the front cover, a clock face imprinted on the front cover, and an hour and minute hand engaged with the clock movement mechanism. The device further comprises a mounting fastener engaged with front cover and clock movement mechanism. The mounting fastener is adapted to allow the device to be hung on a wall.

9 Claims, 5 Drawing Sheets

DEVICE FOR DISPLAYING REAL TIME AND ADVERTISING MEDIA

CROSS-REFERENCE TO RELATED APPLICATIONS

This application claims priority to U.S. Provisional Application Ser. No. 60/785,670 filed on Mar. 24, 2006, now pending, which is hereby incorporated by reference in its entirety into this specification.

BACKGROUND OF THE INVENTION

The present invention relates to clocks and printed catalogs. Conventional printed catalogs consist of multiple sheets or pages of paper bound together by a fastener such as spiral wire binder, staples or any other suitable fastener. Such conventional printed catalogs are commonly filed away or otherwise discarded and as such have a short "shelf life" and consume significant paper pulp in production. Once filed away, the conventional printed catalog fails to perform its purpose which is to advertise and/or inform the recipient.

SUMMARY OF THE INVENTION

The present invention is a device for displaying real time and advertising media to a person. In one embodiment, the device comprises a front cover, a clock engaged with the front cover for displaying real time, and a first sheet having a first advertising portion. The first sheet is moveably engaged with the front cover to an open position where the real time and first advertising portion are visible to the person. The clock comprises a clock movement mechanism engaged with the front cover, a clock face imprinted on the front cover, and an hour and minute hand engaged with the clock movement mechanism. The device further comprises a mounting fastener engaged with the front cover and the clock movement mechanism. The mounting fastener is adapted to allow the device to be hung on a wall.

BRIEF DESCRIPTION OF THE DRAWINGS

The following description of the invention will be more fully understood with reference to the accompanying drawings, in which.

DESCRIPTION OF THE INVENTION

Figure 1:
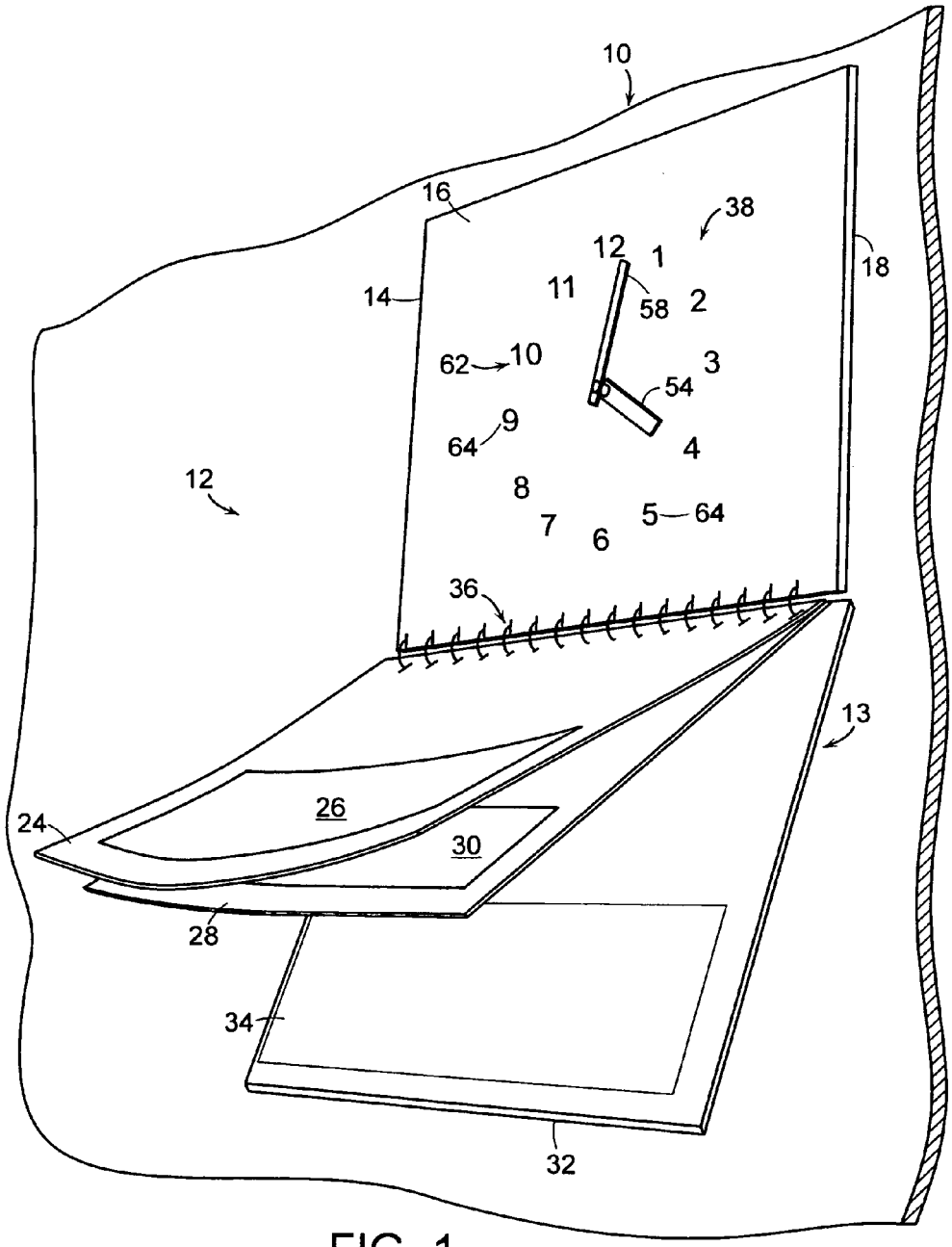
FIG. 1 is a front perspective view of the device according to the present invention shown in an open position and generally comprising a front cover, a clock engaged with the front cover for displaying real time, and a first sheet having a first advertising portion. The first sheet is moveably engaged with the front cover to the open position where the real time and first advertising portion are visible to the person.
Figure 2:
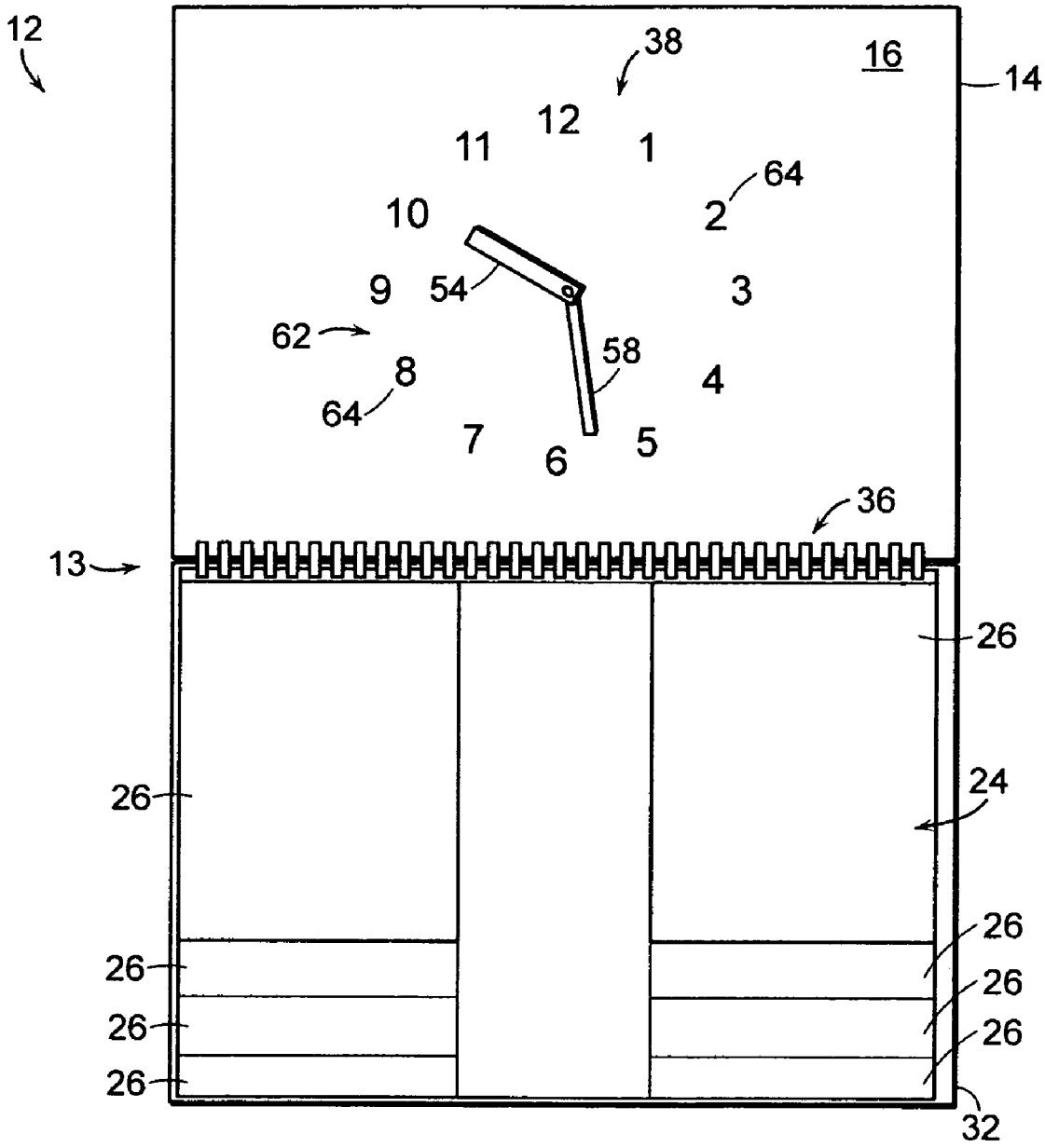
FIG. 2 is a front plan view of the device according to the present invention shown in the open position.
Figure 3:
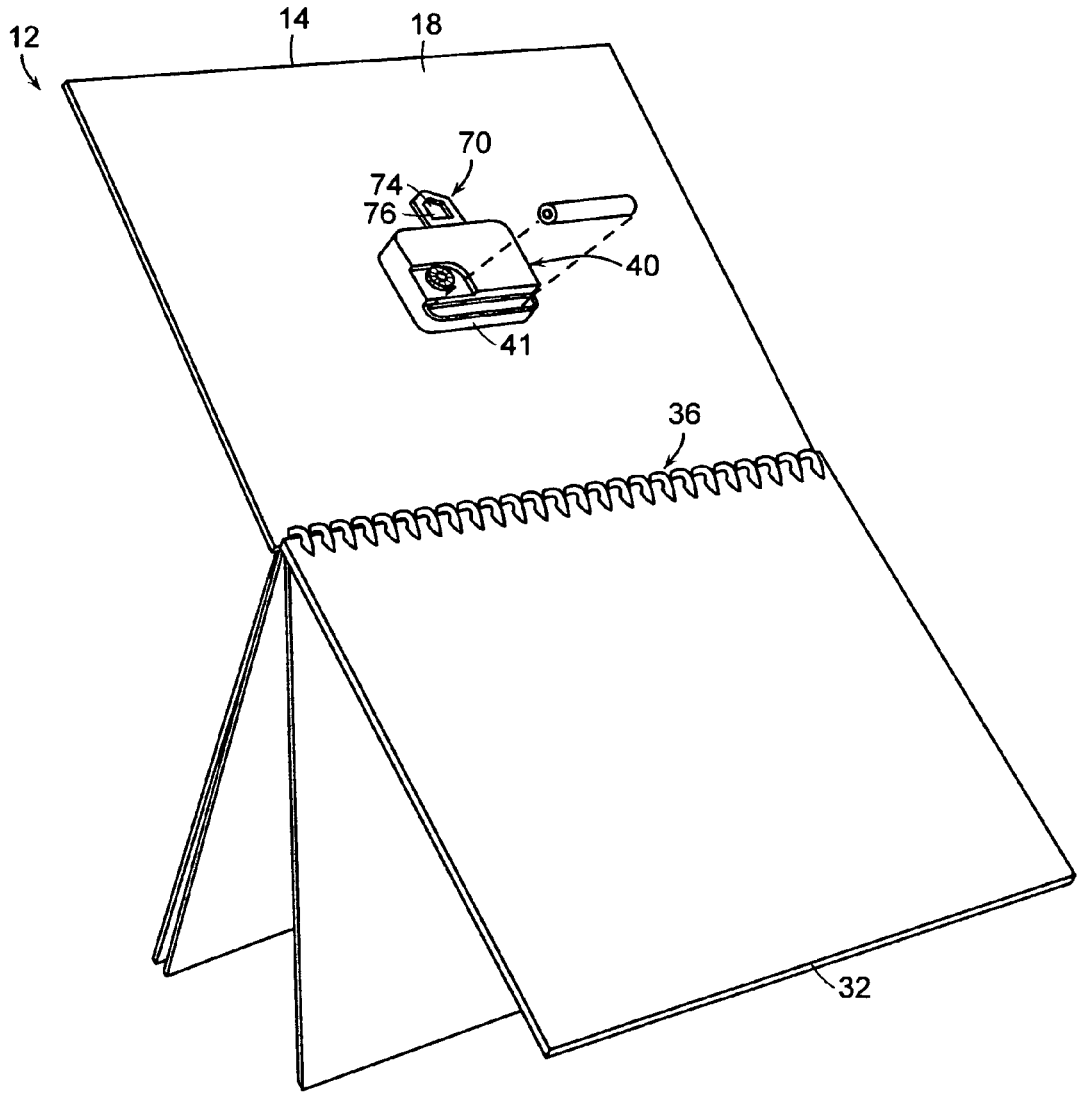
FIG. 3 is rear perspective view of the device according to the present invention showing a clock movement mechanism mounted to a rear side of the front cover and a mounting fastener in the form of a bracket adapted to allow the device to be hung on or otherwise mounted to a wall or other surface.

Referring to FIGS. 1-6, the present invention is a device 12 mounted on a wall 10 that can serve multiple utilities, including as a clock for displaying actual or real time and as a catalog for displaying advertising media to a person. Device 12 generally comprises a catalog 13 having a front cover 14 and a clock 38 engaged with front cover 14 for displaying real time. Catalog 13 further comprises sheets 24 and 26 having advertising portions 26 and 30, respectively. Sheets 24 and 28 are moveably or freely engaged with front cover 14 by a binder 36 to an open position where both the real time and advertising portion 26 are visible to a person. When sheet 24 is removed, advertising portion 30 of second sheet 28 is visible.

Front cover 14 has an inside surface 16, an outside surface 18, and a centrally disposed opening 20. Front cover 14 is substantially rigid and made from cardboard or other suitable material which is readily available and may be fabricated by conventional operations.

Binder 36 may be any type of mechanism capable of moveably engaging front cover 14 with sheets 24 and 28. In the embodiment shown, binder 36 is a wire spiral binder that is well known and readily available. By way of example only, binder 36 may take the form of a stapled or glue binder.

Sheets or pages 24 and 28 are made from a flexible material such as paper which is readily available and may be fabricated by conventional processes. Advertising portions 26 and 30 contain advertising media that may be imprinted on sheets 24 and 28 by well known printing processes. Device 12 may have as many sheets as desired or as limited by the selected binder 36.

Figure 4:
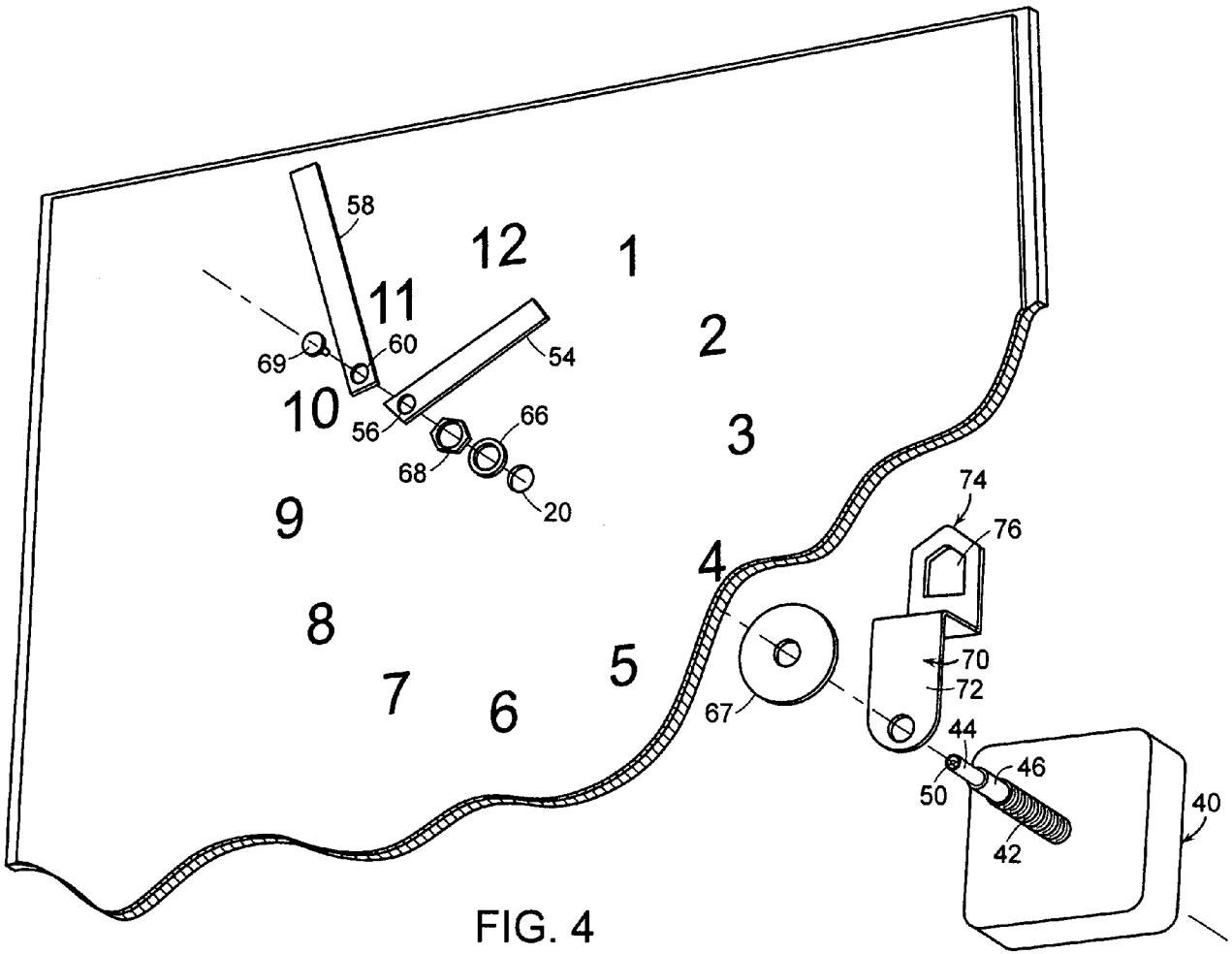
FIG. 4 is an exploded view of the clock movement mechanism mounted to the rear side of the front cover.
Figure 5:
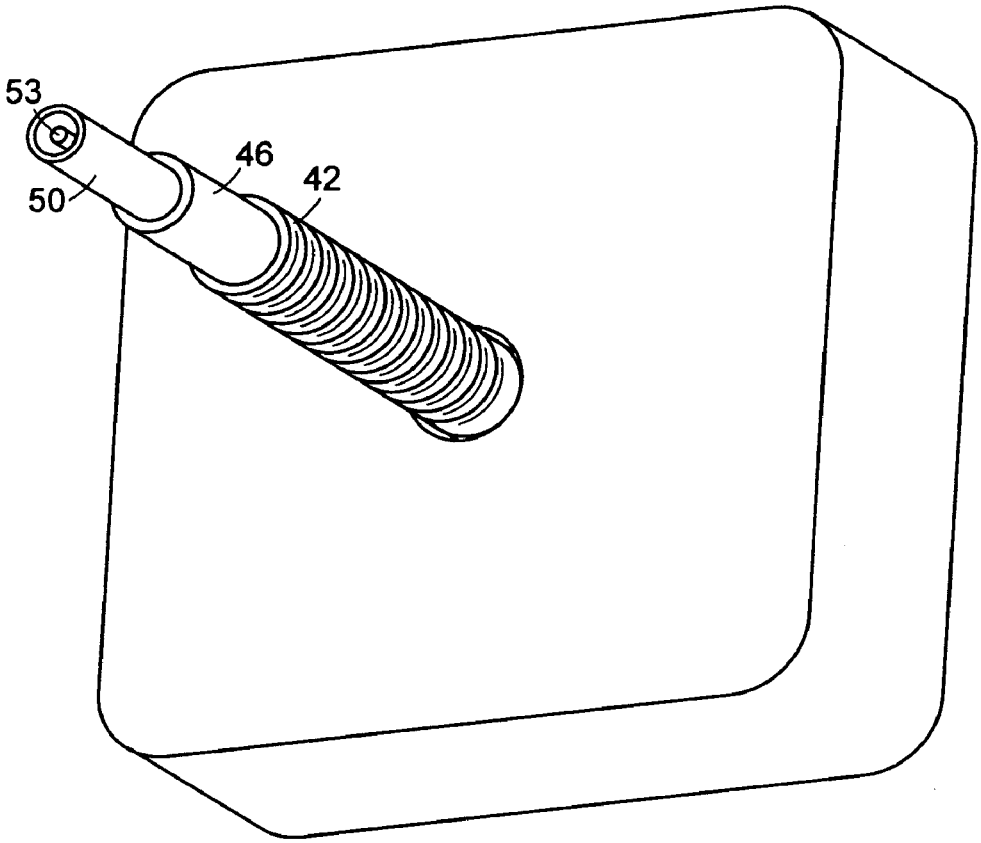
FIG. 5 is a front perspective view of the clock movement mechanism.
Figure 6:
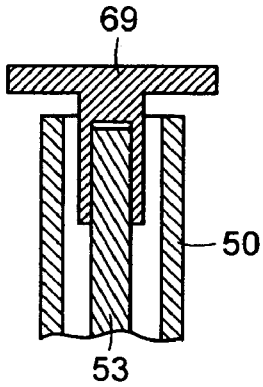
FIG. 6 is a cross-section view showing a cap or third hand mounted to shaft pin 53 disposed with inner hollow shaft 50.

As best shown by FIG. 4, clock 38 comprises a clock movement mechanism 40 mounted to outside surface 18 of front cover 14. Clock movement mechanism 40 is well known and readily available. Clock movement mechanism 40 generally comprises a mounting member 42 having an threaded end portion 44 extending thru central opening 20 of front cover 14. A metal washer 66 and a nut 68 engage threaded end portion 44 to secure clock movement mechanism 40 to outside surface 18 of front cover 14. A flexible washer 67 may be provided to present movement of the clock movement mechanism 40. Clock movement mechanism 40 further comprises a control shaft unit 45 having an outer hollow shaft 46 for indication of hour movement and an inner hollow shaft 50 for indication of minute movement. Outer and inner hollow shafts 46 and 50 have end portions 48 and 52. Inner hollow shaft 50 is disposed within outer hollow shaft 46 and end portion 50 extends outward of end portion 48. Clock movement mechanism 40 further comprises a pin 53 disposed within inner hollow shaft 50. Clock 38 further comprises a hour hand 54 and a minute hand 58 engaged with end portions 48 and 52 of outer and inner hollow shafts 48 and 50, respectively. A fastener portion 56 of hour hand 54 is press-fitted about end portion 48 of outer hollow shaft 46. Similarly, a fastener portion 60 of minute hand 58 is press-fitted about end portion 52 of inner hollow shaft 50. Hour and minute hands 54 and 58 are well known and readily available and in the embodiment shown are made from sheet metal. A cap 69 may also be provided and engaged with shaft pin 53 to provide a third hand movement (not shown) if desired. Clock movement mechanism 40 may be pre-assembled to front cover 14 or assembled by the recipient for ease of shipping and the removal and replacement of the mechanism can be effectuated without the aid of a tool. Clock 38 may further comprise a clock face 62 which in the embodiment shown comprises a plurality of numbers 64 imprinted on inside surface 16 of front cover 14 to designate the time. If front cover 14 is translucent then numbers 64 could be imprinted on the outside surface 18 of front cover 14. Inside surface 16 of front cover 14 serves as the "dial" of clock 38.

Device 12 may further comprise a mounting fastener 70 adapted to allow the device 12 to be hung or otherwise mounted to wall 10 or other surface. In the embodiment shown, mounting fastener 70 has a base portion 72 and an engagement portion 74. Base portion 72 is mounted about shaft 42 and secured between outside surface 18 of front cover 14 and clock movement mechanism 40. Engagement portion 74 extends above clock movement mechanism 40 and has an opening adapted to engage with a hook mounted on the wall 10.

Device 12 may further comprise a rear cover 32 moveably or freely engaged with the binder 36. One or more advertising portions 34 are imprinted upon the inside surface of rear cover 34. Rear cover 32 is substantially rigid and made from cardboard or other suitable material which is readily available and may be fabricated by conventional operations. In other embodiments, the sheets 24 and 28 may be omitted leaving only the front cover 14 and rear cover 32.

Device 12 may further comprise a calendar (not shown). In one embodiment, a calendar mechanism or other information being displayed, is attached to rear cover 32 by an additional binding element such as a spiral binder. Alternatively, the calendar may be engaged with the binder 36. The calendar may comprise a plurality of tear away sheets (not shown) and may precede sheets 24 and 28. The cut-away sheets may be substantially smaller than sheets 24 and 28 when engaged with the binder 36 and may only overlap or cover the top third of sheet 24 leaving the remainder of sheet 24 (sheet 28 if sheet 24 is removed) visible for advertisement portions 26. Alternatively, the calendar may be applied directly to one or more of the sheets 24 and 28.

According to the invention, the characteristics of the device also permit modification of its shape or color by simply changing the die stamp that the front cover 14, sheets 24 and 28 and rear cover 32 are made from and the device will perform the same purpose. Clocks are commonly viewed up to 100 times per day. Because the catalog 13 stays on the wall every day for as long as the clock 38 functions which may be indefinitely, this lowers the cost per impression of the advertisement. Because the inside surface 16 of the front cover 14 serves as the face of the clock 38, manufacturing costs of the clocks are reduced and paper for the catalog 13 is conserved and recycled. The device 12 is easily manufactured and can be folded for storage and shipping and is accessible which are significant benefits to the company distributing the catalog 13. This will also cause the catalog 13 to have a longer "shelf life" which further benefits the company distributing the catalog 13. The combined utility of having a clock and a catalog 13 (and in a another embodiment a calender) conserves paper and is a way to "recycle" catalogs rather than to have the catalog be thrown away. This method of manufacturing is also less expensive and uses less resource than producing these two or three items separately in a traditional manner.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. A device for use by a person comprising:

a front cover having an inside surface, an outside surface, and a centrally disposed opening;

a clock engaged with said front cover for displaying real time; said clock comprises a clock movement mechanism extending thru and outward of said opening of said front cover; said clock further comprises a clock face disposed and imprinted upon said inside surface of said font cover; said clock face comprises a plurality of numbers; said clock further comprises an hour hand engaged with said clock movement mechanism and disposed above said clock face; said clock further comprises a minute hand engaged with said clock movement mechanism and disposed above said clock face;

a first sheet comprising an advertising portion; said first sheet being moveably engaged with said front cover to an open position where said real time of said clock and said advertising portion are visible to the person; and a mounting fastener adapted to allow the device to be secured to a wall; said mounting fastener comprises a bracket having a base portion disposed between said clock mechanism and said outside surface of said front cover and an engagement portion disposed above said clock mechanism.

2. The device of claim 1, further comprising a binder; said first sheet and said front cover being moveably engaged with said binder.

3. The device of claim 2, further comprising a second sheet having a calendar portion; said second sheet being moveably engaged with said binder to an open position where said real time and said calendar portion are visible to the person.

4. The device of claim 3, further comprising a rear cover engaged with said binder.

5. The device of claim 4, wherein said front and rear covers are substantially rigid.

6. The device of claim 5, wherein said first and second sheets are substantially flexible.

7. The device of claim 6, wherein said binder is a spiral binder.

8. The device of claim 7, wherein said clock movement mechanism comprises a mounting member, an outer hollow shaft, and an inner hollow shaft extending thru said opening of said front cover.

9. The device of claim 8, wherein said hour and minute hands are engaged with said outer and inner hollow shafts of said clock movement mechanism.

* * * * *